US006278239B1

(12) United States Patent
Caporaso et al.

(10) Patent No.: US 6,278,239 B1
(45) **Date of Patent: *Aug. 21, 2001**

(54) VACUUM-SURFACE FLASHOVER SWITCH WITH CANTILEVER CONDUCTORS

(75) Inventors: George J. Caporaso, Livermore; Stephen E. Sampayan, Manteca; Hugh C. Kirbie, Dublin, all of CA (US)

(73) Assignee: The United States of America as represented by the United States Department of Energy, Washington, DC (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/094,507

(22) Filed: Jun. 10, 1998

Related U.S. Application Data

(62) Division of application No. 08/668,669, filed on Jun. 25, 1996, now Pat. No. 5,821,705.

(51) Int. Cl.[7] ..... H05H 9/00
(52) U.S. Cl. ..... 315/5.41; 315/505; 313/359.1
(58) Field of Search ..... 315/5.41, 5.42, 315/505, 501; 313/359.1

(56) References Cited

U.S. PATENT DOCUMENTS 4,897,556 * 1/1990 Springfield et al. ..... 315/5.41 X
5,757,146 * 5/1998 Carder ..... 315/5.41 X
5,821,705 * 10/1998 Caporaso et al. ..... 315/505 X

* cited by examiner

*Primary Examiner*—Justin P. Bettendorf
(74) *Attorney, Agent, or Firm*—William C. Daubenspeck; Richard B. Main; Virginia B. Caress

(57) ABSTRACT

A dielectric-wall linear accelerator is improved by a high-voltage, fast rise-time switch that includes a pair of electrodes between which are laminated alternating layers of isolated conductors and insulators. A high voltage is placed between the electrodes sufficient to stress the voltage breakdown of the insulator on command. A light trigger, such as a laser, is focused along at least one line along the edge surface of the laminated alternating layers of isolated conductors and insulators extending between the electrodes. The laser is energized to initiate a surface breakdown by a fluence of photons, thus causing the electrical switch to close very promptly. Such insulators and lasers are incorporated in a dielectric wall linear accelerator with Blumlein modules, and phasing is controlled by adjusting the length of fiber optic cables that carry the laser light to the insulator surface.

1 Claim, 9 Drawing Sheets

V
-
+
40
12
28
10
10
10
10
10
16
14
18
20
22

40
e-
28
V
-
+
12
10
16
14
18
20
22

40
V
-
+
12
28
10
10
10
10
10
16
14
20
18
22
16
14
20
18
22
16
14
-20
18
22
16
14
20
18
22
16
14
20
18
22

VACUUM-SURFACE FLASHOVER SWITCH WITH CANTILEVER CONDUCTORS

CROSS-REFERENCE TO RELATED APPLICATIONS

This application is a divisional application of U.S. patent applciation Ser. No. 08/668,669 filed Jun. 25, 1996 now U.S. Pat. No. 5,821,705.

The United States Government has rights in this invention pursuant to Contract No. W-7405-ENG-48 between the United States Department of Energy and the University of California for the operation of Lawrence Livermore National Laboratory.

BACKGROUND OF THE INVENTION

1. Field of the Invention

The present invention relates to linear accelerators, electrical switches and more particularly to very high-voltage and high-current switches, such as are needed for dielectric-wall linear accelerators and pulse-forming lines that operate at high gradients, e.g., in excess of twenty megavolts per meter.

2. Description of Related Art

Donald W. Hunter describes a laser-initiated dielectric-breakdown switch in U.S. Pat. No. 5,249,095, issued Sep. 28, 1993. Such switches are used in safe and arm systems for initiating exploding foil initiators. One electrode has an opening which allows light from a laser source to shine on dielectric material to induce voltage breakdown. Electrical conduction is precipitated through a dielectric, by solid dielectric breakdown between the electrodes, and this switch closing allows energy to pass from a power supply to the electronic foil initiator (EFI). Switches with high voltage ratings, e.g., tens of thousands of volts, are needed to hold off the magnitude of voltages typically found on an energy storage capacitor, e.g., 2–3 kilovolts (kV), for a single EFI. When triggered, such switches must produce an unusually fast rise time pulse, in order to initiate the EFI. Typical pulses must have stored energies of 0.3–0.6 millijoules, rise times of 30–60 nanoseconds, peak currents of 3–7 kiloamps (kA), and peak powers of 5–15 megawatts (MW). A commonly used switch for such applications is the ceramic body, hard brazed, miniature spark gap, with either an internal vacuum or a gas filled volume. But such spark gaps require hermetic sealing, are expensive, have marginal reliability and operating life, and require an expensive high voltage trigger circuit. One other switch in use for this application is the explosively initiated shock conduction switch which uses a primary explosive detonator. But this presents handling problems and can produce chemical contamination and possible explosive damage to surrounding electronics.

Other, conventional types of miniature switches include embedded electrode dielectric breakdown switches, e.g., as marketed by Mound Labs MLM-MC-88-28-000, reverse-bias diode avalanche switches, e.g., as marketed by Quantic Industries and Mound Labs, that are either electrically or light initiated, and gallium arsenide bulk conduction switches. But embedded electrode dielectric breakdown switches require a high voltage and a relatively high-energy trigger pulse from an expensive trigger circuit. Reverse bias diode avalanche switches require a significant number of components for both the switch and trigger circuit. Gallium arsenide switches are expensive, may require hermetic sealing, and often require high power for initiation, e.g., much more power than a laser diode can provide.

Particle accelerators are used to increase the energy of electrically-charged atomic particles, e.g., electrons, protons, or charged atomic nuclei, so that they can be studied by nuclear and particle physicists. High energy electrically-charged atomic particles are accelerated to collide with target atoms, and the resulting products are observed with a detector. At very high energies the charged particles can break up the nuclei of the target atoms and interact with other particles. Transformations are produced that help to discern the nature and behavior of fundamental units of matter. Particle accelerators are also important tools in the effort to develop nuclear fusion devices.

The energy of a charged particle is measured in electron volts, where one electron volt is the energy gained by an electron when it passes between electrodes having a potential difference of one volt. A charged particle can be accelerated by an electric field toward a charge opposite that of the charged particle. Beams of particles can be magnetically focused, and superconducting magnets can be used to advantage. Early machines in nuclear physics used static, or direct, electric fields. Most modern machines, particularly those for the highest particle energies, use alternating fields, where particles are exposed to the field only when the field is in the accelerating direction. When the field is reversed in the decelerating direction, the particles are shielded from the field by various electrode configurations.

The simplest radio frequency accelerator is the linear accelerator, or linac, and comes in different forms, depending electrons or ions are to be accelerated. For accelerating ions, frequencies of under 200 MHz are used. The ions are injected along the axis of a long tank excited by high-power radio frequency in an electric field along the axis. The ions are shielded from the decelerating phases by drift tubes in the tank through which the beam passes. As the particles gain energy and velocity, they travel farther. Therefore, the drift tubes must be longer toward the end of the tank to match the period of the accelerating field.

The first linear accelerator had three drift tubes and was built in 1928 by Rolf Wideroe of Norway. Sodium and potassium ions were accelerated to demonstrate the principle of radio frequency acceleration. During the 1930's, the University of California did further work on ion-type linear accelerators. But application of the principle was delayed until after World War II because of a lack of high-power radio frequency amplifiers. The development of radar provided such amplifiers. Shortly after the war, Luis Walter Alvarez built the first proton linear accelerator in which protons reached an energy of 32 million electron volts (MeV). Two megawatts were required at a frequency of about 200 MHz and limited the machine to one millisecond pulses.

Since 1950, several proton and ion linear accelerators have been built, some as injectors for still larger machines and some for use in nuclear physics. A large modern accelerator is the 800-MeV machine at the Los Alamos Scientific Laboratory, New Mexico, and is used as a meson factory in the study of intermediate-mass particles, e.g., those with masses heavier than the electron and lighter than the proton. These intermediate-mass particles seem to provide the force that binds atomic nucleus.

Because electrons are much lighter than ions, their velocity at a given energy is significantly higher than that of ions. The velocity of a one-MeV proton is less than five percent that of light. In contrast, a one-MeV electron has reached ninety-four percent of the velocity of light. This makes it possible to operate electron linacs at much higher frequencies, e.g., about 3,000 MHz. The accelerating system for electrons can be a few centimeters in diameter. The accelerating systems for ions need diameters of a few meters. Electron linacs having energies of ten to fifty MeV are widely used as x-ray sources for treating tumors with intense radiation.

A very large electron linac, which began operation in 1966 at the Stanford Linear Accelerator Center (California), is more than 3.2 km (2 mi.) long and has been able to provide electrons with energies of fifty billion electron volts (50 GeV). The Stanford Linear Collider can provide relative collisions that produce energies of more than 100 GeV between a beam of electrons and a beam of positrons that are aimed to collide head-on.

Such conventional accelerators are primarily useful for low currents, due to the interaction of the beam with the accelerator structure and the applied electric field. Induction accelerator types avoid many such problems.

FIG. 1 shows a cross-section of a single induction accelerator cell in which an accelerating voltage appears only across an internal accelerating gap. The cell housing and the outside of the accelerator are at ground potential. A large number of induction cells can be stacked in series to produce high energy beams without needing proportionately high voltages outside the accelerator that can be dangerous and troublesome to maintain. The core is a solid cylinder of either ferro-magnetic or ferri-magnetic with a coaxial central hole for the beam current. The core imparts a very large inductance to a conducting path that begins on the entire outside circumference of the core at the coaxial feed and wraps around one end to the inside circumference to the opposite end and the housing ground. A high voltage pulse from the coaxial feedline creates a field along a vacuum accelerating gap that drives a beam current (particle beam) through the axis of the core. The vacuum accelerating gap appears to be in parallel with a large inductance. In a typical induction cell, the cell is generally azimuthally symmetric except for a number of coaxial feed lines that supply the accelerating voltage from a pulsed-power unit. The inductive isolation of the voltage persists in time until the core saturates, the inductance reduces to a very low value, and the voltage is shunted to ground. In practice, accelerator cores are driven towards negative saturation after the accelerating pulse to increase the available flux swing. After the application of a reset pulse, the field inside the core will relax to $B_r$, the remnant field. As the core is subjected to an accelerating pulse, the magnetic domains of the core all align and the permeability of the material falls. The core is then said to be saturated and the field level is $B_s$.

Unidirectional, direct current, high voltage pulses are used for particle acceleration, e.g., pulsed power systems, rather than high frequency alternating current. Conventional pulsed power systems for induction cells include devices constructed of nested pairs of coaxial transmission lines, so-called "Blumlein" devices, e.g., as shown in FIG. 2. See, U.S. Pat. No. 2,465,840, issued 1948 to A. D. Blumlein, and incorporated here by reference. A step-up transformer or Marx bank slow charging system is connected between an intermediate conductor of the Blumlein and a grounded outer conductor. The output is taken between an inner conductor and the outer conductor which then provides a coaxial drive signal to the induction cell. When the Blumlein is fully charged, there is no net output voltage. But when a switch is closed to ground, a voltage wave is caused to propagate, left to right in FIG. 2, between the inner and outer conductor of the line to the output. This voltage feeds the induction cell with a relatively fast pulse, e.g., on the order of tens of nanoseconds. The switch most often used includes high voltage electrodes separated by an insulating gas, e.g., a spark gap. Conventionally, a third trigger electrode is placed between the main two spark gap electrodes and voltage pulsed to initiate a breakdown. Alternatively, a laser is used to ionize the insulating gas. The breakdown of the gas allows current to flow with a very low resistance. But such systems are repetition-rate limited by the recovery time of the spark gap switch. Higher repetition rates can be realized by blowing the insulating gas through the spark gap switch. Even so, such types of switches are limited to repetition rates that do not exceed several kilohertz.

A 50-MeV advanced test accelerator at Lawrence Livermore National Laboratory was constructed with a pulsed power system that used water-filled Blumleins of beam current for 70 nanoseconds at one Hz for extended periods. It could also provide short power bursts at one kHz by using gas blowers for the spark gaps.

In the early 1980's, free electron lasers were developed which required high average beam power in certain applications, e.g., microwave heating of tokamaks. A magnetic pulse compression power system capable of providing multi-kilohertz operation was developed. Instead of spark gaps, such magnetic pulse compressor systems used saturable magnetic switches, as illustrated in FIG. 3 with a simplified schematic. A capacitance $C_1$ is slowly charged to approximately twenty-five kV by an external source. When the volt-seconds capacity of the magnetic saturable switch $M_1$ has been reached, its impedance rapidly collapses and the charge on the capacitor is dumped to ground through the primary of a step-up transformer to produce a still higher voltage across a capacitor $C_2$. When the volt-seconds capacity of a second magnetic saturable switch $M_2$ has been reached, capacitor $C_2$ discharges into a water-filled transmission or pulse-forming line PFL 11. A third magnetic saturable switch $M_3$ then couples the output of the PFL 11 into a bank of induction cells 13 in parallel. The transfer of energy from one capacitor to the next occurs more rapidly in each succeeding stage if the product of the saturated switch inductance and the storage capacitance drops from one stage to the next. A similar system was used to power the ETA-II accelerator at Lawrence Livermore National Laboratory and is now in fairly wide use. The ETA-II machine produces as many as fifty pulse bursts at rates exceeding three kHz. Each so-called MAG 1-D pulse compressor has been able to drive as many as twenty accelerator cells at approximately 125 kV with a beam current in excess of two kiloamperes (kA).

But such low repetition rates were sorely inadequate by the 1990's. One promising approach to inertial confinement fusion was the use of heavy ion beams to drive the targets. In typical designs, ten GeV uranium ions are needed at tens of kiloamperes for an efficient power plant. Two configurations suitable for heavy ion fusion use induction accelerator technology, e.g., linear induction accelerators and recirculators. Useful recirculators require repetition rates far in excess of those that can be achieved by magnetic pulse compression. The standard approach to providing such beams has been to use induction linacs operated at about ten Hz. But with conventional technology, a linear induction accelerator would need to be about ten kilometers long. Recirculating a beam through small number of induction cells can substantially reduce the cost, but the induction cells would have to be able to operate at pulse repetition rates as high as 100 kHz.

The operational demands imposed on a pulsed power system to properly operate a recirculating induction linac are severe. The accelerating pulse shape and duration are preferably modified as the ions accelerate and the beam is longitudinally compressed. A typical induction linac is capable of producing beams in the kiloampere range with an average accelerating gradient as great as one megavolt/meter.

Vacuum surface flashover or discharge switches initiated by a conventional plasma discharge are conventional. Such switches exhibit low jitter and current rise rates that exceed most all other switches. Surface flashover switches have not been very reliable because such switches must operate very near their voltage breakdown points. Such operation near this threshold voltage, the "self-break electric field", is required for low jitter, e.g., repeatable delays between the time the trigger is received and the time the switch actually closes. A Weibull distribution shows that the reliability of a surface flashover switch operated at 0.90 of the self-break electric field has 0.60 reliability. In contrast, a surface flashover switch operated at 0.60 of the selfbreak electric field is 0.995 reliable.

It has been discovered by the present inventors that the self-break electric field of a vacuum insulator can be lowered significantly if sufficient photons of a given energy are incident on the surface. The self-break electric field can be reduced by 75% with 29 millijoule-cm$^{-2}$ 248 nanometers fluence onto the surface. The surface flashover appears to occur with very low jitter.

SUMMARY OF THE INVENTION

An object of the present invention is to provide an improved dielectric-wall linear accelerator.

Another object of the present invention is to provide a high voltage, high current electrical switch.

A further object of the present invention is to provide an electrical switch for operating a linac at very high repetition rates.

Another object of the present invention is to provide an electrical switch capable of operating with gradients in excess of twenty megavolts per meter and able to support rapid-rise-time pulse currents of greater than several amperes.

Briefly, a high-voltage, fast rise-time switch embodiment of the present invention comprises a pair of electrodes between which are laminated alternating layers of isolated conductors and insulators, e.g., metal depositions and semiconductive-type insulators. A high voltage is placed between the electrodes that is sufficient to stress the dielectric of the insulator assembly. A laser is focused along at least one line along the edge surface of the laminated alternating layers of isolated conductors and insulators and extends between the electrodes. The laser is energized to initiate a surface breakdown by a fluence of photons, thus causing the electrical switch to close very promptly. Alternatively, such laminated alternating layers of isolated conductors and insulators and such lasers are incorporated into a dielectric wall linear accelerator with Blumlein modules. Module switch phasing is controlled by adjusting the length of fiber optic cables that carry the laser light to the insulator surface.

An advantage of the present invention is that a switch is provided that is able to withstand very high voltages.

Another advantage of the present invention is that a switch is provided that is able to support very rapid current rise times and very high currents.

A further advantage of the present invention is that a switch and linac are provided that support very high voltage gradients.

BRIEF DESCRIPTION OF THE DRAWINGS

FIGS. 4A–4C are a time-series of cutaway-perspective diagrams illustrating the operation of a single Blumlein accelerator module wherein FIG. 4A illustrates a switch connected to allow a middle conductive plate to be charged by a high voltage source, FIG. 4B illustrates the inward propagation of voltage waves immediately after the switch is closed to short the middle conductive plate to the top and bottom plates, and FIG. 4C illustrates the outward propagation of the fast wave after it reflects back from the inner surface of the Blumlein module;

FIGS. 6A–6C are a time-series of cutaway-perspective diagrams illustrating the operation of a multiple module Blumlein accelerator wherein FIG. 6A illustrates a the electric field with a switch connected to allow a middle conductive plate to be charged by a high voltage source, FIG. 6B illustrates the state of the electric field immediately after the switch is closed to short the middle conductive plate to the top and bottom plates, and FIG. 6C illustrates the state of the electric field after the fast wave reflects back from the inner surface of the Blumlein module;

DETAILED DESCRIPTION OF THE INVENTION

Figure 1:
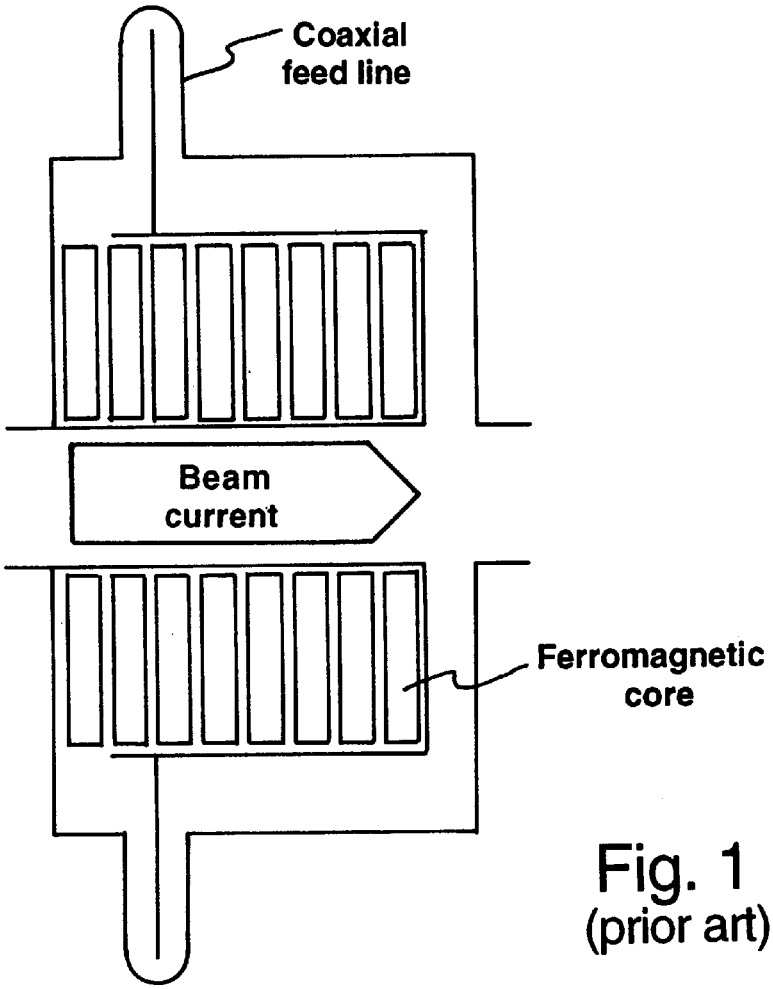
Fig. 1 (prior art)
FIG. 1 shows a cross-section of a prior art induction cell in which an accelerating voltage appears only across an internal accelerating gap.
Figure 2:
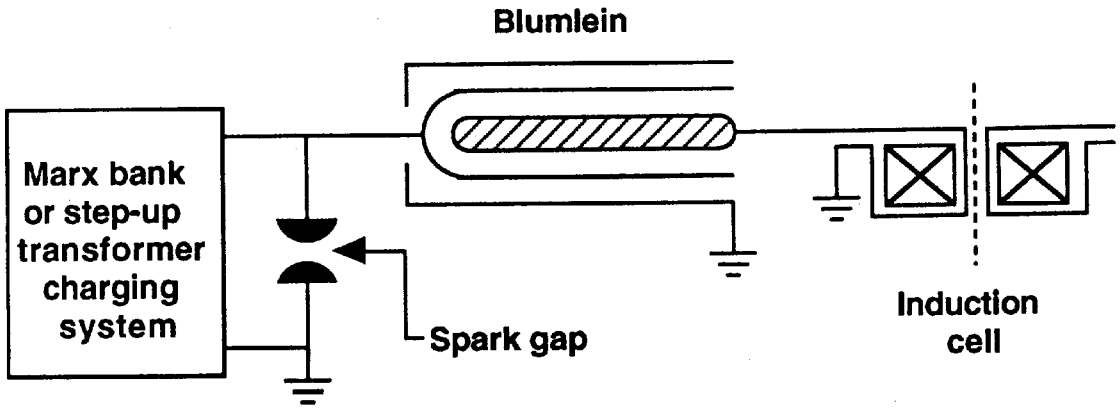
Fig. 2 (prior art)
FIG. 2 is a diagram of a prior art Blumlein-type of pulse power system for an induction cell like that of FIG. 1.
Figure 3:
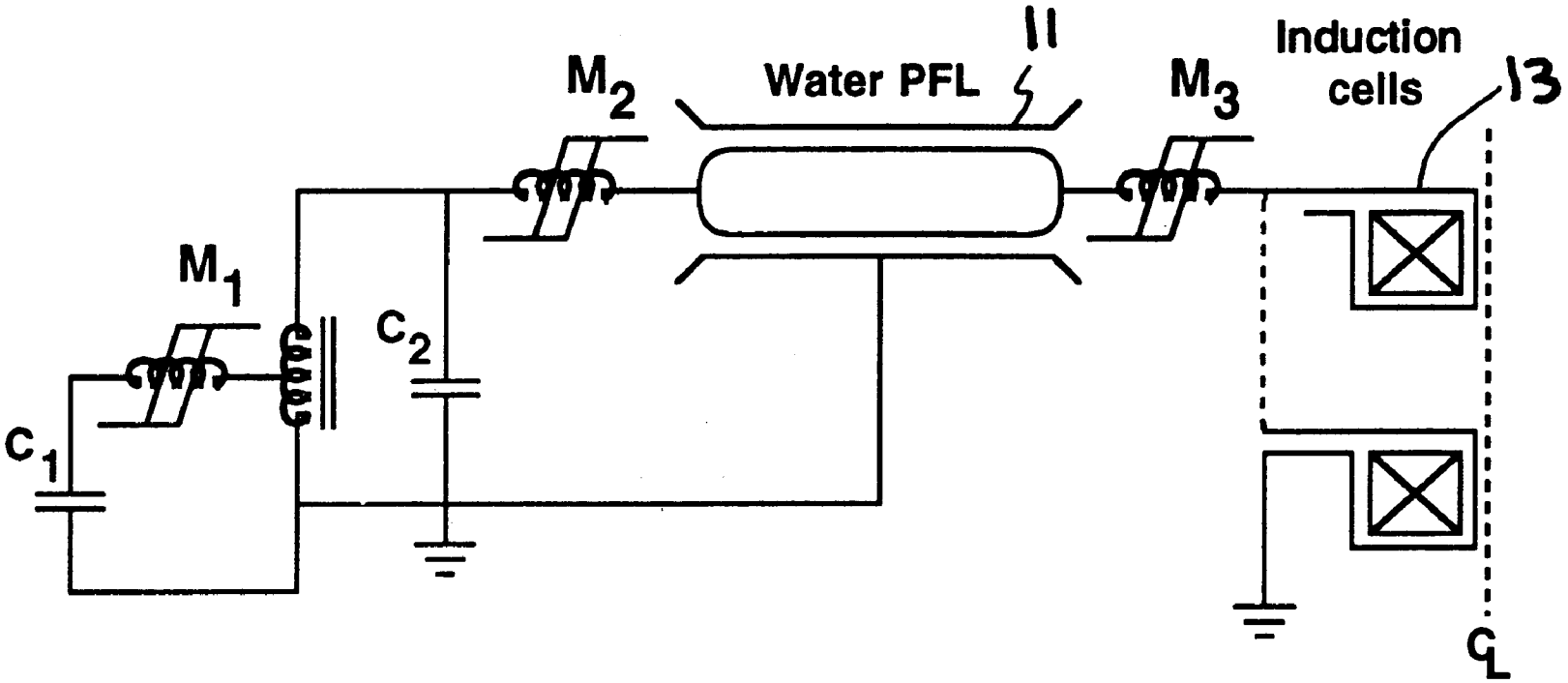
Fig. 3 (prior art)
FIG. 3 is a diagram of a prior art water-filled pulse-forming-line-type of pulse power system with magnetic saturation switches.
Figure 4A:
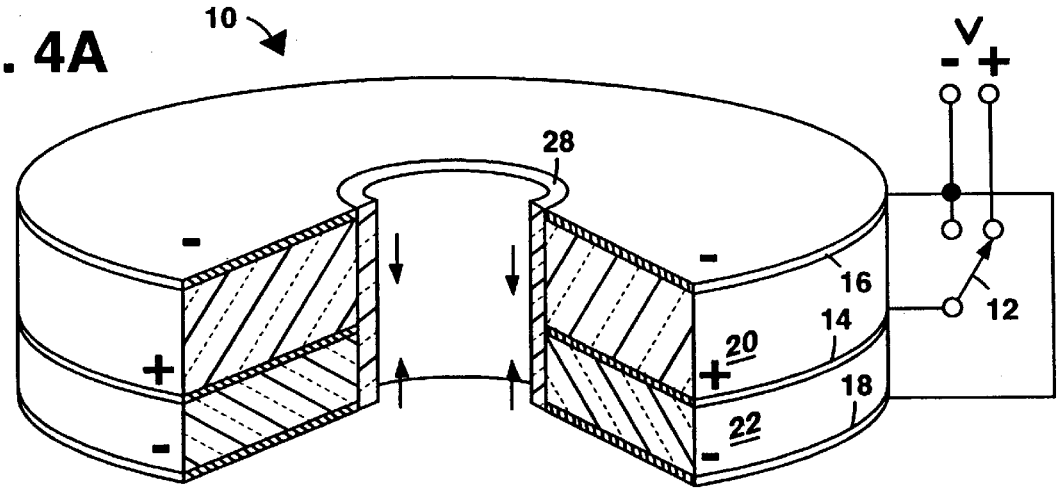
Figure 4B:
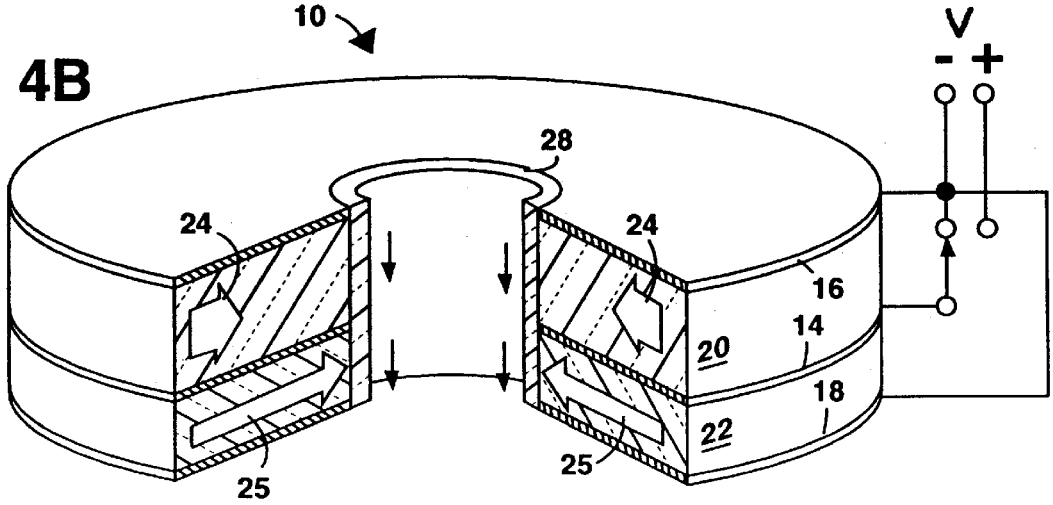
Figure 4C:
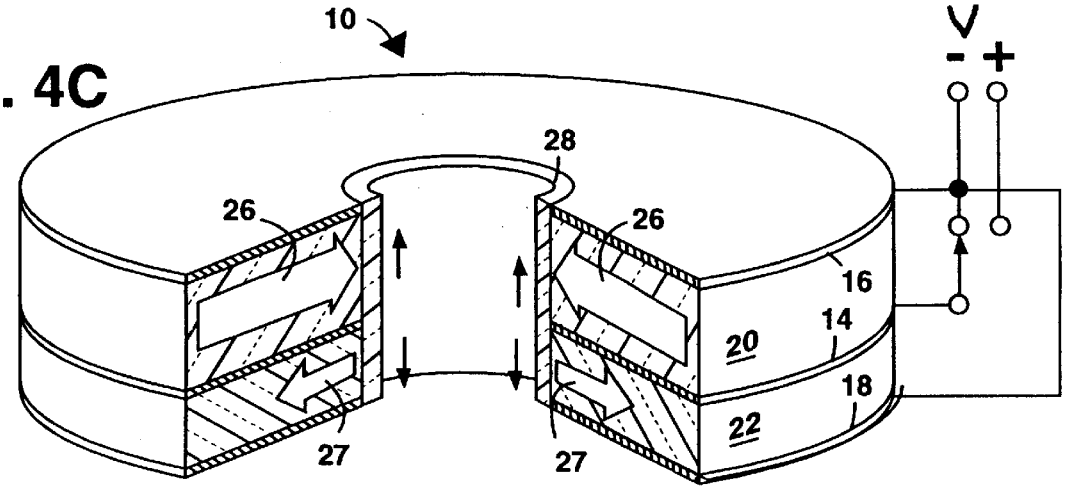

FIGS. 4A–4C illustrate a single accelerator cell for a Blumlein linear accelerator (linac) module of the present invention, referred to herein by the general reference numeral 10. FIGS. 4A–4C represent a time-series that is related to the state of a switch 12. In a first condition at to, the switch 12 is connected so as to be able to short circuit a middle conductive plate 14 a pair of top and bottom conductive plates 16 and 18. The switch 12 is connected to allow the middle conductive plate 14 to be charged by a high voltage source. A laminated dielectric 20 with a relatively high dielectric constant, $\epsilon_1$, separates the conductive plates 14 and 16, for example titanium dioxide may be used. A laminated dielectric 22 with a relatively low dielectric constant, $\epsilon_2$, separates the conductive plates 14 and 18, for example ordinary printed circuit board substrates may be used like RT Duroid epoxy. Preferably, the dielectric constant $\epsilon_1$ is nine times greater than the dielectric constant $\epsilon_2$. The middle conductive plate 14 is set closer to the bottom conductive plate 18 than it is to the top conductive plate 16, such that the combination of the different spacing and the different dielectric constants results in the same characteristic impedance on both sides of the middle conductive plate 14. Although the characteristic impedance may be the same on both halves, the propagation velocity of signals through each half is not at all the same. The higher dielectric constant half with laminated dielectric 20 is much slower. This difference in relative propagation velocities is represented by a short fat arrow 24 and a long thin arrow 25 in FIG. 4B, and by a long fat arrow 26 and a reflected short thin arrow 27 in FIG. 4C. The vertical arrows in FIGS. 4A–4C (and in FIGS. 6A–6C also) indicate the instantaneous direction of the electric field along the axis of the Blumlein accelerator.

Figure 7:
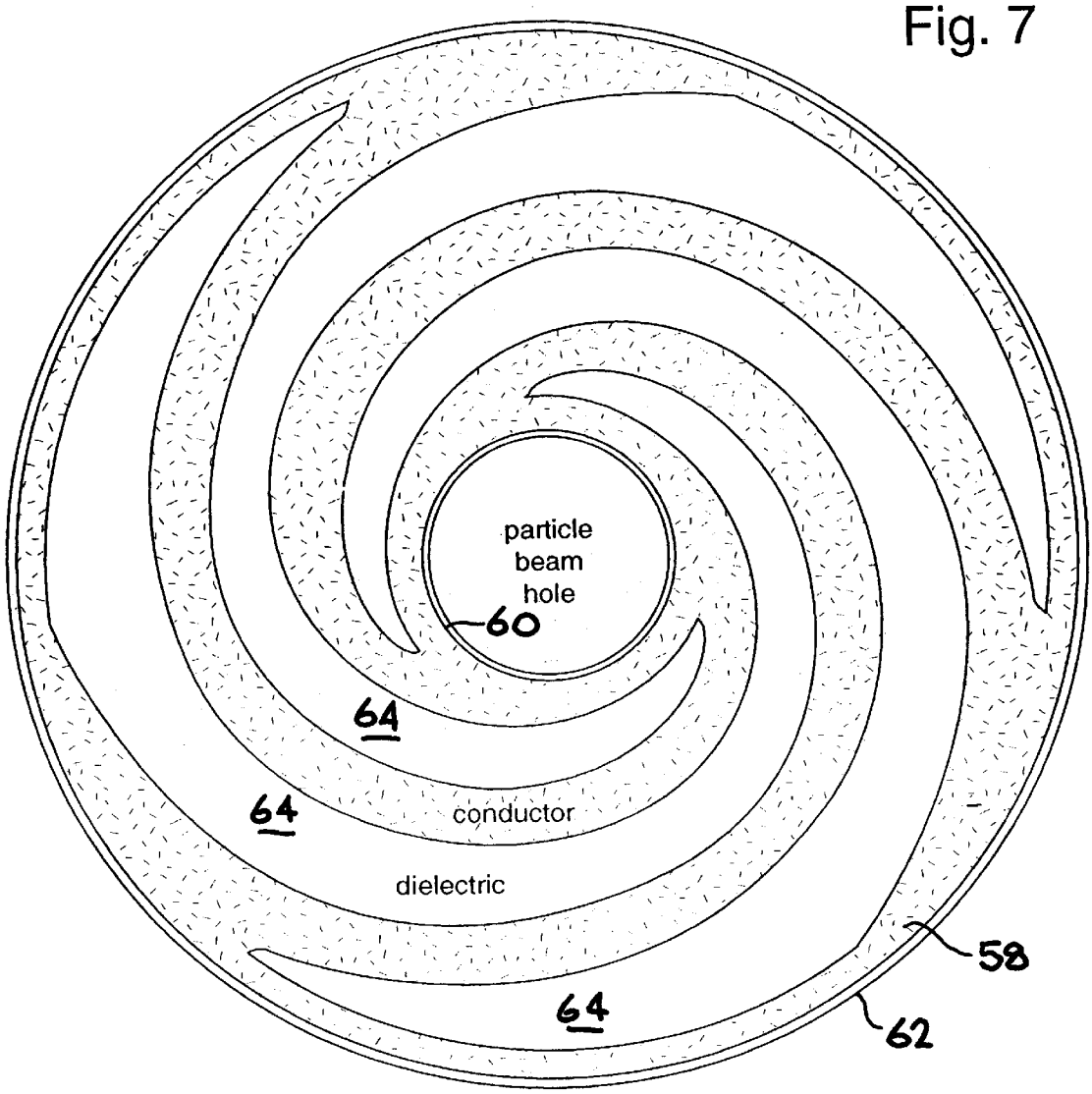
FIG. 7 is a plan view of a spiral conductor plate included in the construction of a spiral Blumlein module.

The single accelerator cell 10 can be thought of as consisting of two radial transmission lines which are filled with different dielectrics. The line having the lower value of dielectric constant is called the "fast" line and the one having the higher dielectric constant is termed the "slow" line. Initially, both lines are oppositely charged so that there is no net voltage along the inner length of the assembly. After the lines have been fully charged, the switch 12 closes across the outside of both lines at the outer diameter of the single accelerator cell. This causes an inward propagation of the voltage waves 24 and 25 which carry opposite polarity to the original charge such that a zero net voltage will be left behind in the wake of each wave as shown in FIG. 4B. When the fast wave 25 hits the inner diameter of its line, it reflects back from the open circuit it encounters. Such reflection doubles the voltage amplitude of the wave 25 and causes the polarity of the fast line to reverse. This is because twice the original charge voltage is subtracted from the original charge voltage in the wave 25 at the reflection. For only an instant moment more, the voltage on the slow line at the inner diameter will still be at the original charge level and polarity. After the wave 25 arrives but before the wave 24 arrives at the inner diameter, the field voltages on the inner ends of both lines are oriented in the same direction and add to one another, as shown in FIG. 4B. Such adding of fields produces an impulse field that can be used to accelerate a beam. Such an impulse field is neutralized, however, when the slow wave eventually arrives and reverses the polarity of the slow line, as is illustrated in FIG. 4C. The time that the impulse field exists can be extended by increasing the distance that the voltage waves 24 and 25 must traverse. One way is to simply increase the outside diameter of the single accelerator cell. Another, more compact way is to replace the solid discs of the conductive plates 14, 16 and 18 with one or more spiral conductors that are connected between conductor rings at the inner and/or outer diameters, as is illustrated in FIG. 7. For example, the spiral conductors may be patterned in copper clad using standard printed circuit board techniques on both sides of a fiberglass-epoxy substrate that serves as the laminated dielectric 22. Multiple ones of these may then be used to sandwich several dielectrics 20 to form a stack.

The laminated dielectrics 20 and 22 are preferably constructed of thin layers of conventional insulating materials alternated with finely spaced floating metal electrodes, e.g., similar insulators have been built and tested by Tetra Corporation (Albuquerque, N. Mex.). See, J. Elizondo and A. Rodriguez, Proc. 1992 15th Int. Symp. on Discharges and Electrical Insulation in Vacuum (Vde-Verlag Gmbh, Berlin, 1992), pp. 198–202. The spatial period of such alternations in the laminated dielectrics 20 and 22 preferably are in the approximate range of 0.1–1.0 millimeters (mm), albeit the lower end of the range has yet to be determined precisely because very specialized equipment and instruments are necessary.

A widely held view of the process by which an insulator-vacuum interface breaks down contends that there is an enhancement of the electric field at triple points, e.g., points where there is an intersection of a vacuum, a solid insulator and an electrode. Electrons that are field emitted from a triple point on a cathode initially drift in the electric field between the end plates of the insulator which is a dielectric and is polarized by the electrons. This results in an electric field which attracts the electron into the surface of the insulator. The electron collisions with the surface can liberate a greater number of electrons, depending upon the electron energy of the collisions. This can lead to a catastrophic event in which the emission of these electrons charges the insulator surface, leads to more collisions with the surface, and the release of even more electrons. This growing electron bombardment desorbs gas molecules that are stuck to the insulator surface and ionizes them, creating a dense plasma which then electrically shorts out the surface of the insulator between the electrodes, e.g., secondary electron emission avalanche (SEEA).

The scale length for the electron hopping distance along a conventional insulator's surface can be on the order of a fraction of a millimeter to several millimeters. When isolated conductive lamination layers are alternated with insulator lamination layers, SEEA current is prevented such that no current amplification can take place. The electron current amplification due to secondary emission is stopped when the electrode spacing is comparable to the electron hopping distance. Direct bombardment of the surface by charged particles or photons can still liberate electrons from the insulator, but the current will not avalanche below a certain critical field. Surface breakdown then requires the bombardment by charged particles or photons that is so intense that adsorbed gas is ionized or enough gas is released from the surface that an avalanche breakdown in the gas occur between the plates.

The theory of insulator surface flashover has been a controversial subject for many years, the foregoing discussion may not ultimately be proved correct, but that is immaterial to the construction of embodiments of the present invention. In order to test this insulator concept a large sample, e.g., twenty-two centimeter outer diameter by two centimeter in axial length, of a commercial high gradient insulator was acquired and placed at the end of a pulse line so that it would be subjected to a longitudinal electric field. The cathode end of the insulator included an anodized aluminum plate, e.g., anodized to suppress field emission. The anode end was connected to a highly transparent wire mesh, e.g., greater than 98% optically transparent. Two experiments were conducted. In the first experiment, the insulator was subjected to twenty nanoseconds full width at half maximum pulses and withstood up to twenty-five megavolts/meter without any sign of a breakdown and without detectable emitted current from the cathode plate. In the second experiment, a piece of velvet cloth, which is a good field emitter, was silver epoxied onto the cathode plate, thus turning the test fixture into a diode. Up to one thousand amps could be extracted from the diode at a gradient of 20 megavolts/meter without detectable breakdown of the insulator. When a higher gradient was attempted signs of breakdown towards the end of the pulse were detected. Voltage and current waveforms were constructed from the diode tests for three different values of impressed electric field. The data showed a normal applied voltage pulse and the measured emitted beam current from the downstream current monitor. An increase in applied voltage resulted in some anomalous increase in emitted current towards the tail of the pulse and in a sharpening of the tail of the voltage pulse. This became even more pronounced when the voltage collapsed halfway through the pulse, indicating that a breakdown has occurred. Many such breakdowns occurred during testing with no apparent damage to the insulator or degradation in its voltage holding ability.

As shown in FIGS. 4A–4C, a sleeve 28 fabricated from a dielectric material is molded or otherwise formed on the inner diameter of the single accelerator cell 10 to provide a dielectric wall, which may be comprised of high gradient insulator material. A particle beam is introduced at one end of the dielectric wall 28 that accelerates along the central axis. Velvet cloth field emitters can be used as a source of electrons at the closed and grounded end. The dielectric sleeve 28 is preferably thick enough to smooth out at the central axis the alternating fields represented inside the walls by the vertical arrows in FIGS. 4A and 4C. Such dielectric sleeve 28 also helps prevent voltage flashover between the inside edges of the conductive plates 14, 16 and 18, therefore the sleeve 28 should be tightly fitted or molded in place. The dielectric constant of the material of the sleeve 28 is preferably four times that of the laminated dielectric 22. Thus the preferred ratio of dielectric constants amongst the dielectrics 22 and 20 and the sleeve 28 is 1:9:4.

Figure 5:
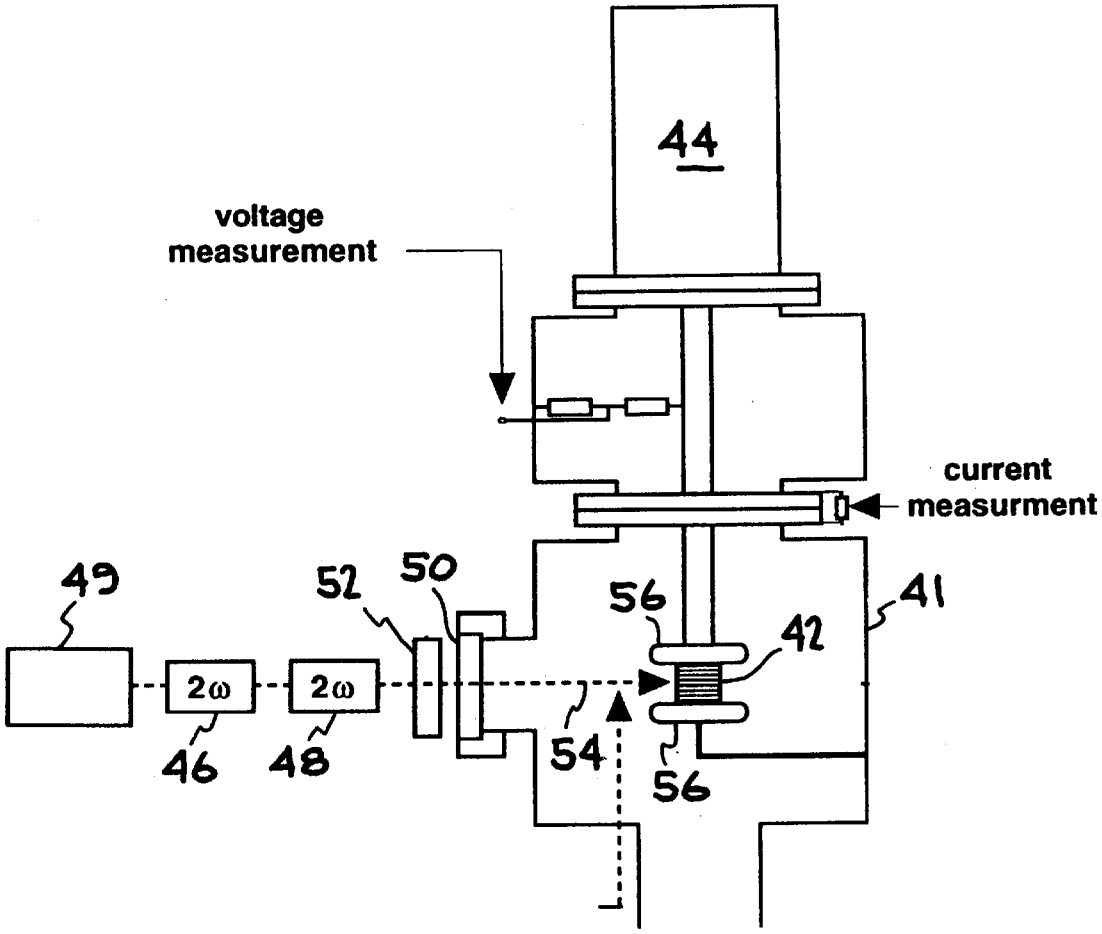
FIG. 5 represents a vacuum chamber that was constructed to charge a high gradient insulator sample to high voltage with a Marx bank, a frequency multiplied Nd-YAG laser (1.06$\mu$) throws a line focus along the outside surface of the high gradient insulator sample through a port and lenses.

A suitable closing switch mechanism for the switch 12 that can operate at the high voltage gradients required by the single accelerator cell is illustrated in FIG. 5. When the outer surface of the fast and slow lines are at a high electric field stress it can be near to a surface breakdown. Such breakdowns are very prompt, and this mechanism makes for an ideal closing switch, but only if it is controlled, e.g., by illuminating the line surface with a prompt flux of photons to precipitate breakdown. A vacuum chamber 41 was constructed that permitted a high gradient insulator sample 42 to be charged to high voltage with a conventional Marx Bank 44. A frequency-multiplied (in doubling crystals 46 and 48) NdYAG laser 49 (1.06$\mu$) was introduced through a port 50 and a cylindrical lens 52. A line focus 54 (>50 millijoules, 248 nm) was thrown approximately one millimeter by one centimeter along the outside surface of the high gradient insulator sample 42 between its limits at the electrodes 56. The fluence required to initiate the breakdown was measured as a function of charge voltage across the sample 42 and the wavelength of the incident light. It was found that a few millijoules per switch point was sufficient to obtain reliable breakdown. The laser-induced surface flashover switch appeared to work well at gradients up to 150 kV/cm, carrying two kiloamps in the tests.

Figure 6A:
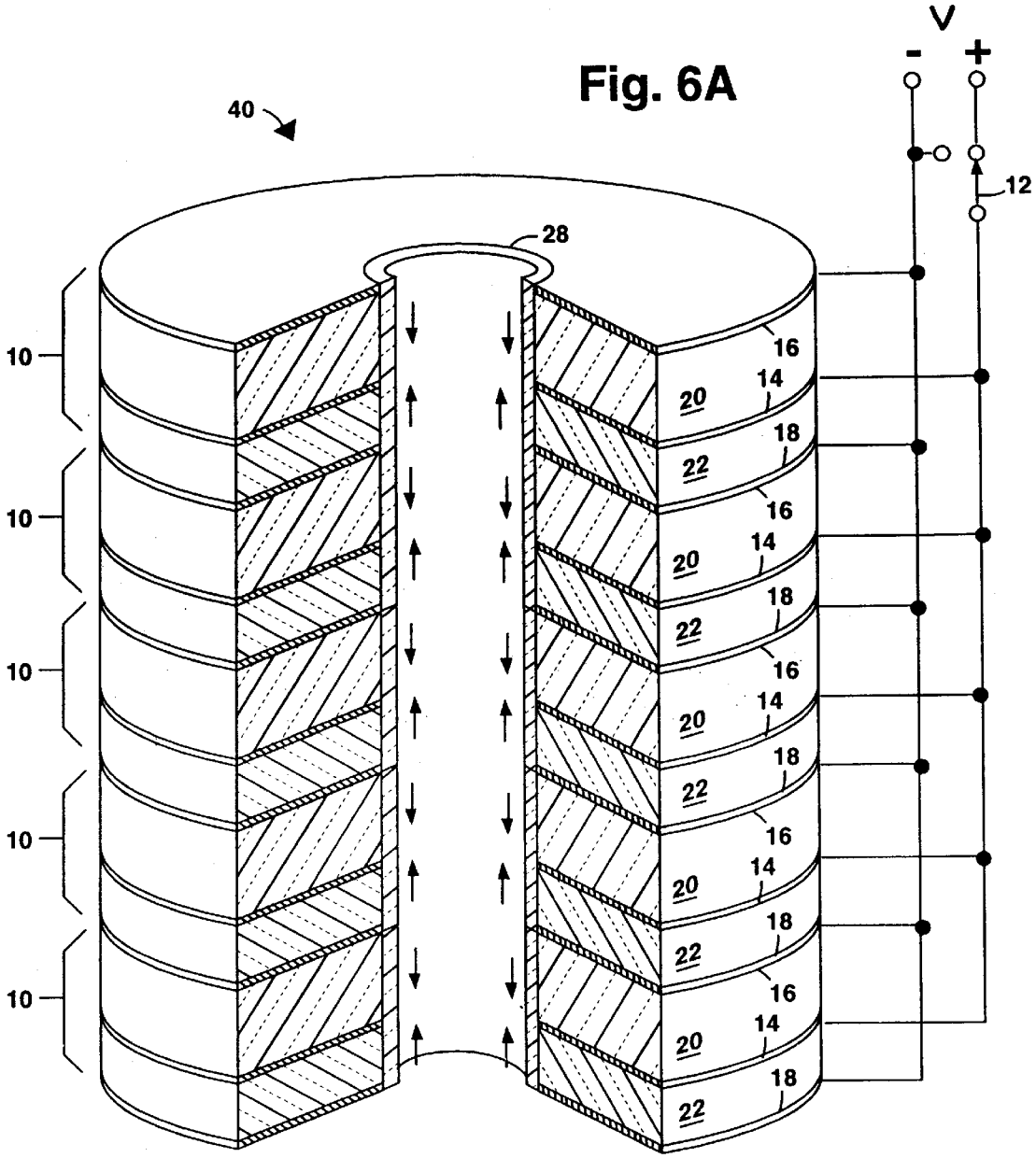
Figure 6B:
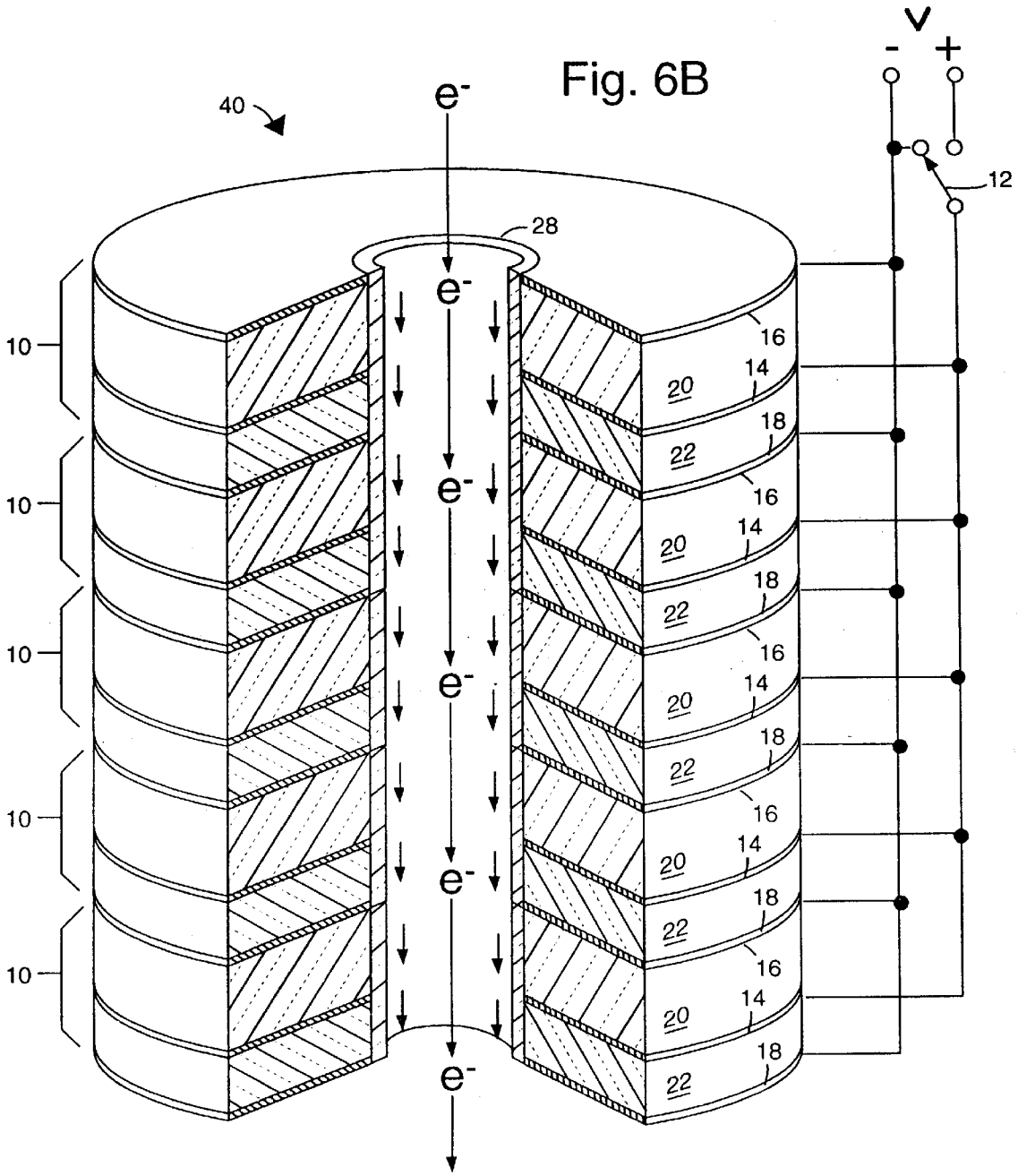
Figure 6C:
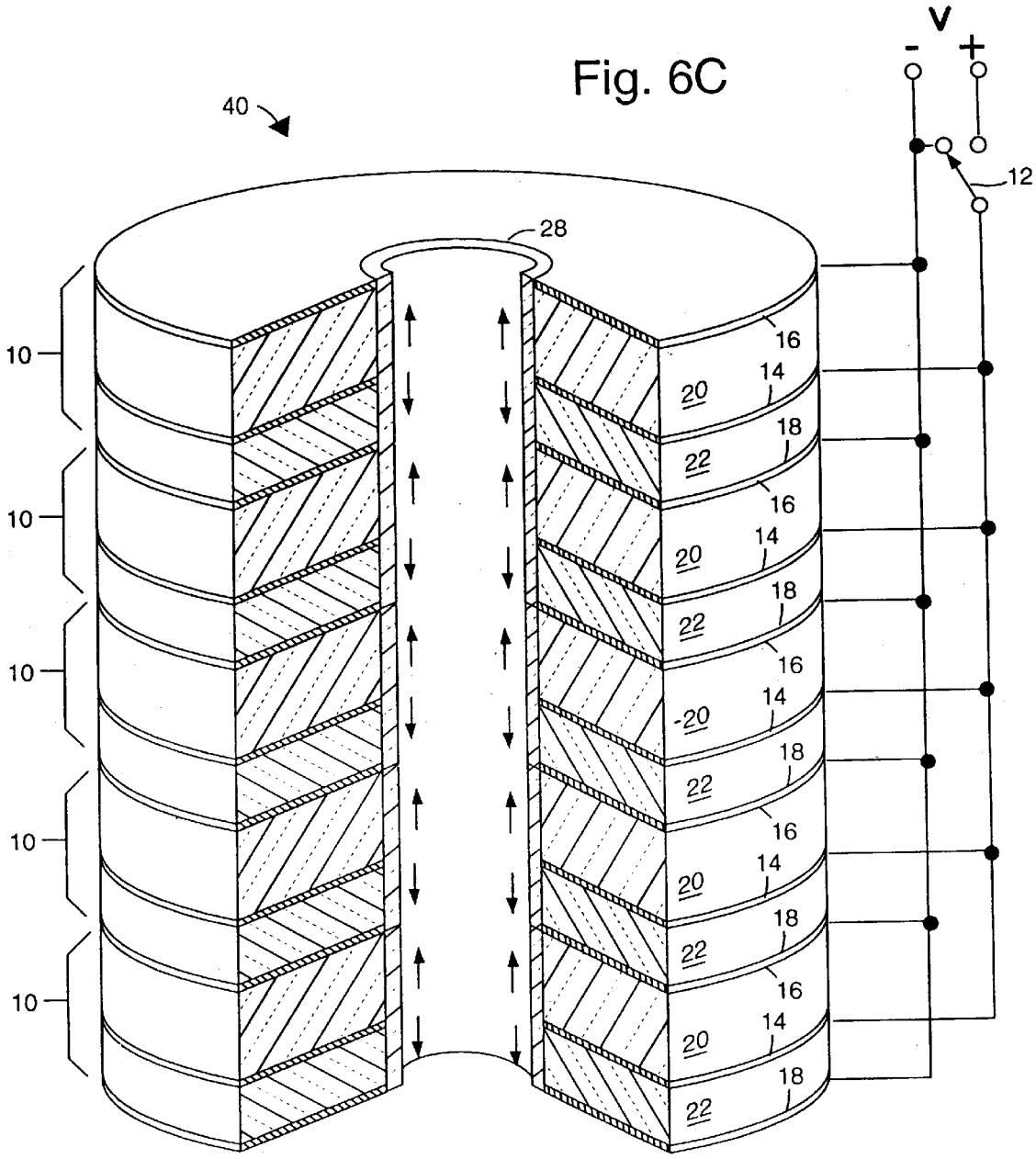

FIGS. 6A–6C illustrate a multi-stage linac system 40 for use in a vacuum chamber. A time series similar to that shown for FIGS. 4A–4C is represented. The net effect of five accelerator cells 10 that all share a common stalk comprising dielectric sleeve 28 is shown in each of the drawings. A laser surface flashover switch can be used in place of switch 12 in which laser light is directed to the outer surface via a bundle of fiber optic cables that provide several switch points per line for each of the five linacs 10. It may be possible to demonstrate gradients at least as high as five megavolts/meter with careful insulation and choice of dielectrics.

FIG. 7 illustrates that the solid disks of the conductive plates 14, 16 and 18 may be replaced by one of more spiral conductors 58 that are connected between conductor rings 60 and 62 at the inner and outer diameter, respectively. The spiral conductors are separated by dielectrics areas 64.

Figure 8:
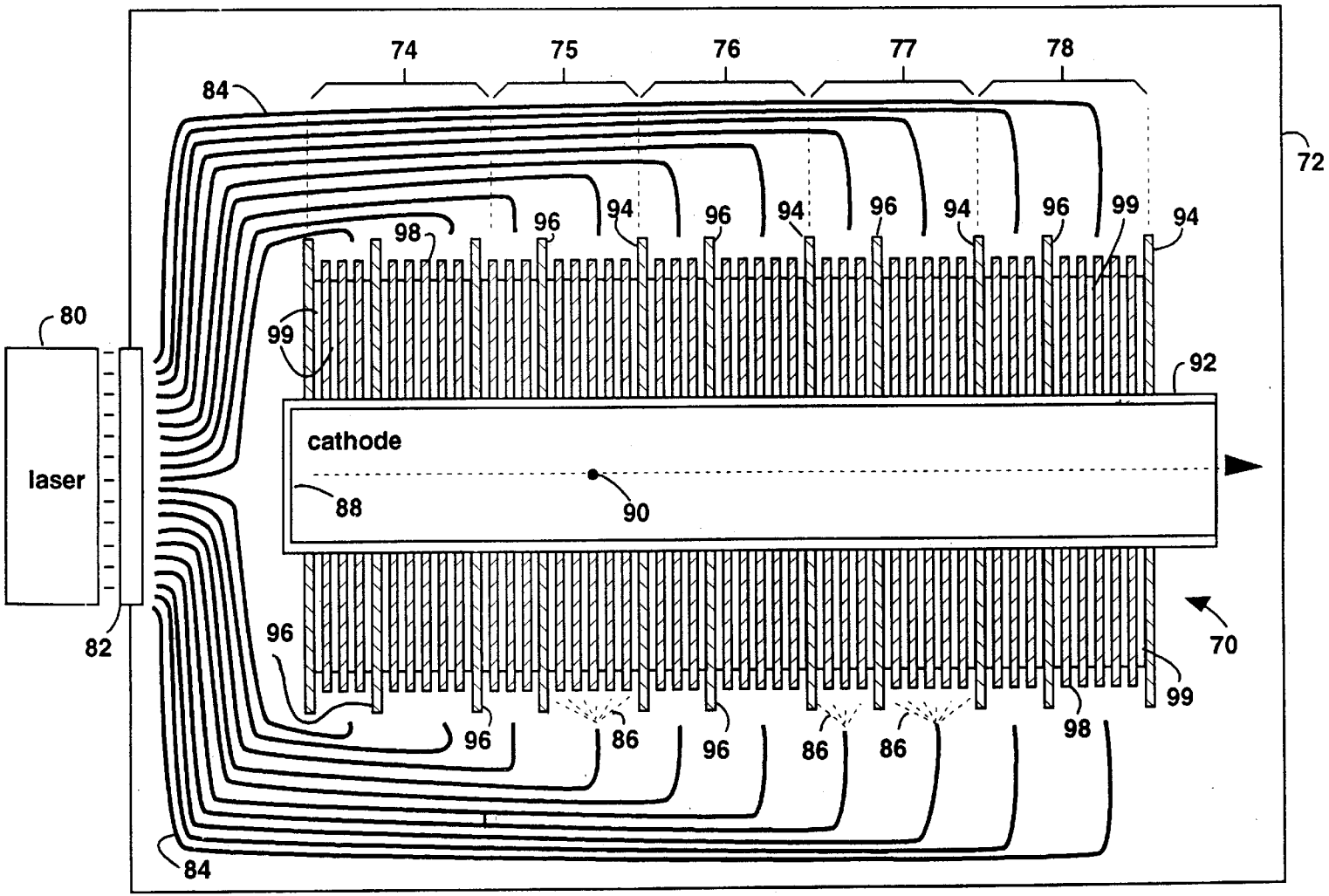
FIG. 8 is a cross-sectional diagram of an application of the vacuum-surface flashover switch of the present invention, taken through the longitudinal axis of a cylindrical multi-stage linac system that is disposed within a vacuum.

FIG. 8 shows an application of the vacuum-surface flashover switch of the present invention. A multi-stage linac system 70 is disposed within a vacuum 72. The multi-stage linac system 70 is similar to the system 40 of FIGS. 6A–6C and comprises a set of five Blumlein linac modules 74, 75, 76, 77, and 78 that are each similar to the Blumlein linac modules 10 of FIGS. 4A–4C. In a preferred embodiment, a frequency doubled, tripled, or quadrupled Nd-YAG laser 80 is used to produce a laser light pulse that is passed through a port 82 and routed through a bundle of fiber optic cables 84 to the stack of Blumlein linac modules 74–78, e.g., with each linac receiving twelve azimuthally spaced lines of focus 86. Lines of focus that were one millimeter by one centimeter on the surface have produced good switching results. A velvet cloth field emitter serves as a cathode 88 that emits particles, e.g., an electron 90 that is accelerated longitudinally within a dielectric sleeve 92, e.g., from left to right in the drawing. Each Blumlein linac module 74–78 includes a first electrode plate 94, e.g., for connection to ground, and a second electrode plate 96, e.g., for charging to a high voltage potential. Each electrode plate 94 and 96 is mechanically similar in construction to the spiral conductor plate of FIG. 7.

Between each electrode 94 and 96 there is a lamination of alternating thin sheets of isolated conductors 98 and insulators 99 in a stack disposed between the pair of electrodes. The lamination is functionally equivalent to the insulators 20 and 22 of FIGS. 4 and 6A–6C. The lamination of alternating thin sheets of isolated conductors and insulators is preferably such that each thin sheet has a thickness in the approximate range of 0.1–1.0 mm. Stainless steel is a suitable conductive material and KAPTON, LEXAN (polycarbonate) and MYLAR (polyester) are suitable insulator materials for the isolated conductors 98 and insulators 99. Thickness ratios of 4:1 to 6:1 appear to give the best results. Alternatively, each of the thin sheets of conductor 98 should cantilever out further into said vacuum than do each of said thin sheets of insulator 99. Such cantilevered extensions of conductor prevent the surface coupling between thin sheets of insulator that could otherwise occur and allow premature flashover during electrical stress.

The lengths of each group of constituent fiber optic cables in the bundle 84 that are associated with a particular one of the accelerator cells 74–78 may be staged in length relative to the adjacent sets, e.g., in order to phase the switch closings from one accelerator cell to the next in sequence. This would be advantageous in long linacs or where heavier particles 90 are being accelerated and the velocity does not permit a complete axial transition from one end to the opposite end in a single impulse time.

In operation, when voltage gradients of twenty megavolts per meter are applied to the system 70 and, in a preferred embodiment, a prompt flux of ultraviolet (UV) photons is delivered by the fiber optic bundle 84 to the lines of focus 86, a breakdown can be reliably induced that functions as a fast, high-current switch.

In alternative embodiments, a plasma source may be used to initiate a switch-action breakdown across the surface of the insulators. High gradient insulators may be used in the construction of exterior walls of the linacs to gain further advantage.

Although particular embodiments of the present invention have been described and illustrated, such is not intended to limit the invention. Modifications and changes will no doubt become apparent to those skilled in the art, and it is intended that the invention only be limited by the scope of the appended claims.

The invention claimed is:

1. A vacuum-surface flashover switch, comprising:

a pair of electrodes providing for the application of a high voltage potential;

an insulator assembly disposed between the pair of electrodes and having at least one surface between the pair of electrodes exposed to a vacuum;

the insulator assembly comprising a lamination of alternating thin sheets of isolated conductors and discrete insulators or semiconductive insulators in a stack disposed between the pair of electrodes and have at least one surface between the pair of electrodes exposed to said vacuum;

wherein the lamination of alternating thin sheets of isolated conductors and insulators in a stack is such that each thin sheet has a thickness in the range of 0.1 mm to several millimeters, and each of said thin sheets of conductor cantilever out further into said vacuum than do each of said thin sheets of insulator, and light source means for directing a flux of photons to fall on said surface between the pair of electrodes exposed to said vacuum for precipitating an electrical current flashover between the pair of electrodes.

* * * * *